United States Patent [19]

Wainwright

[11] Patent Number: 4,909,228

[45] Date of Patent: Mar. 20, 1990

[54] IGNITION APPARATUS

[75] Inventor: Basil E. Wainwright, Yardley Wood, England

[73] Assignee: Novatech Energy Systems, Inc., New York, N.Y.

[21] Appl. No.: 264,014

[22] Filed: Oct. 28, 1988

[30] Foreign Application Priority Data

Nov. 3, 1987 [GB] United Kingdom ..... 8725702

[51] Int. Cl.[4] ..... F02P 3/02

[52] U.S. Cl. ..... 123/607; 123/620; 123/143 B

[58] Field of Search ..... 123/143 B, 594, 606, 123/607, 620, 626

[56] References Cited

U.S. PATENT DOCUMENTS

| | | | |
|---|---|---|---|
| 4,398,526 | 8/1983 | Hamai et al. | 123/143 B |
| 4,409,952 | 10/1983 | Canup | 123/606 X |
| 4,418,660 | 12/1983 | Endo et al. | 123/606 X |
| 4,562,823 | 1/1986 | Moritugu et al. | 123/620 |
| 4,619,241 | 10/1986 | Yoshinari | 123/620 |

*Primary Examiner*—Willis R. Wolfe

*Attorney, Agent, or Firm*—Roylance, Abrams, Berdo & Goodman

[57] ABSTRACT

Ignition apparatus for providing plasma ignition for an engine, which ignition apparatus comprises a switching circuit, a wave form generator for generating an a.c. wave form output, a power amplifier circuit for amplifying the output from the wave form generator, a d.c. to d.c. inverter, and a transformer having primary and secondary windings, the primary winding being connected to the power amplifier circuit for receiving the output from the power amplifier circuit, and the secondary winding being connected to the d.c. to d.c. inverter, and the wave form generator and the d.c. to d.c. inverter being connected in parallel so that during operation of the ignition apparatus high voltage a.c. from the wave form generator carries and sustains d.c. which is from the d.c. to d.c. inverter and which is required for the plasma.

6 Claims, 2 Drawing Sheets

IGNITION APPARATUS

Figure 1A:
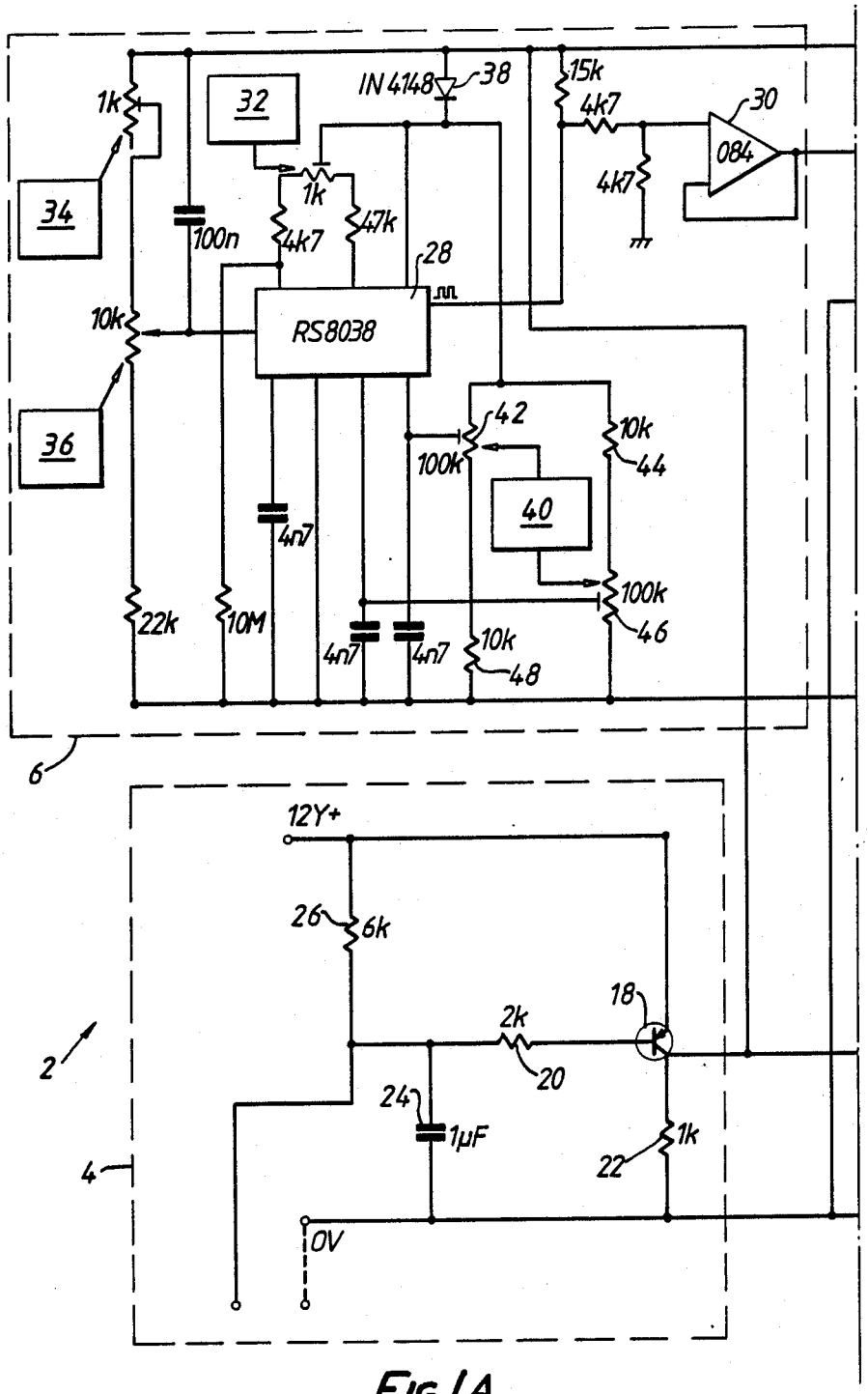

This invention relates to ignition apparatus and, more especially, this invention relates to ignition apparatus for providing plasma ignition for an engine. This invention also relates to an engine when provided with the ignition apparatus.

Conventional ignition systems currently in use employ contact breaker systems which operate such that when a contact breaker opens, the voltage within the primary winding of an ignition coil collapses and induces a high voltage pulse in the secondary winding of the ignition coil. The ignition coil is a transformer and the high voltage output is used to form a spark at a spark plug, thus initiating combustion of fuel. The output pulse from the ignition coil and therefore the generated spark is of a very short time duration and it has little energy content. As modern engines have improved using better breathing techniques, higher swirl conditions and leaner mixtures, the conventional ignition systems are becoming less and less efficient in ensuring complete combustion of fuel.

In an attempt to overcome the problems associated with the above mentioned conventional ignition systems, it is known to use ignition apparatus for providing plasma ignition for an engine. This known ignition apparatus is not satisfactory in that the plasma tends to quench in high swirl conditions associated with lean burn engines. If increased d.c. energy is provided in order to stop the plasma quenching, then the spark plug electrodes vapourise which considerably reduces the life of the spark plug. Similar vapourisation tends to occur at the distributor rotor and in the distributor cap.

It is an aim of the present invention to provide ignition apparatus for providing plasma ignition for an engine, which ignition apparatus improves on the above mentioned conventional ignition systems using contact breakers, and which ignition apparatus obviates or reduces the above mentioned problems associated with known ignition apparatus for providing plasma ignition.

Accordingly, this invention provides ignition apparatus for providing plasma ignition for an engine, which ignition apparatus comprises a switching circuit, wave form generator means for generating an a.c. wave form output, a power amplifier circuit for amplifying the output from the wave form generator means, a d.c. to d.c. inverter, and transformer means having primary and secondary windings, the primary winding being connected to the power amplifier circuit for receiving the output from the power amplifier circuit, and the secondary winding being connected to the d.c. to d.c. inverter, and the wave form generator means and the d.c. to d.c. inverter being connected in parallel so that during operation of the ignition apparatus high voltage a.c. from the wave form generator means carries and sustains d.c. which is from the d.c. to d.c. inverter and which is required for the plasma.

The ignition apparatus runs at the moment the switching circuit is switched on. The switching may be effected by any trigger source such for example as a Hall effect device, or an infra red device, or a magnetic or Kettering contact device. The wave form generator means and the d.c. to d.c. inverter remain running until the switching circuit is switched off. The high frequency wave form which is output from the wave form generator means and the power amplifier circuit carries the d.c. voltage from the d.c. to d.c. inverter to form the plasma source for the ignition, for example for use at one or more spark plugs and/or at one or more ignitor units. Typically, the d.c. to d.c. inverter may produce 4000 volts d.c. Thus the plasma afforded by the ignition apparatus of the invention tends not to quench in high swirl conditions associated with lean burn engines, and vapourisation at plug electrodes, distributor rotors and in distributor caps is maintained within acceptable levels. Furthermore, the plasma afforded by the ignition apparatus is suitable for multi-fuel applications where high energy ignition is critical.

Preferably, the switching circuit comprises a transistor, a pair of resistances connected across the transistor, and a capacitance connected across the pair of resistances.

The waveform generator means preferably generates a square wave form output. If desired, however, the wave form generator means may generate other wave form outputs such for example as sine or triangular wave form outputs.

The wave form generator means may comprise a square wave form generator, and a pre-amplifier for amplifying the output from the square wave form generator and for providing an amplified signal for the power amplifier circuit. Preferably, the wave form generator means is a 1.5 kilocycle oscillator circuit.

The wave form generator means may include a duty cycle device for controlling the operating time of the square wave form generator.

Preferably, the d.c. to d.c. inverter comprises oscillator means for converting low voltage d.c. to low voltage a.c., transformer means for receiving the low voltage a.c. output from the oscillator means and for generating high voltage a.c., and rectifier means for rectifying the high voltage a.c. into high voltage d.c. Preferably, the rectifier means is a half wave rectifier means. The rectifier means may also be full wave rectifier means if desired.

Figure 1B:
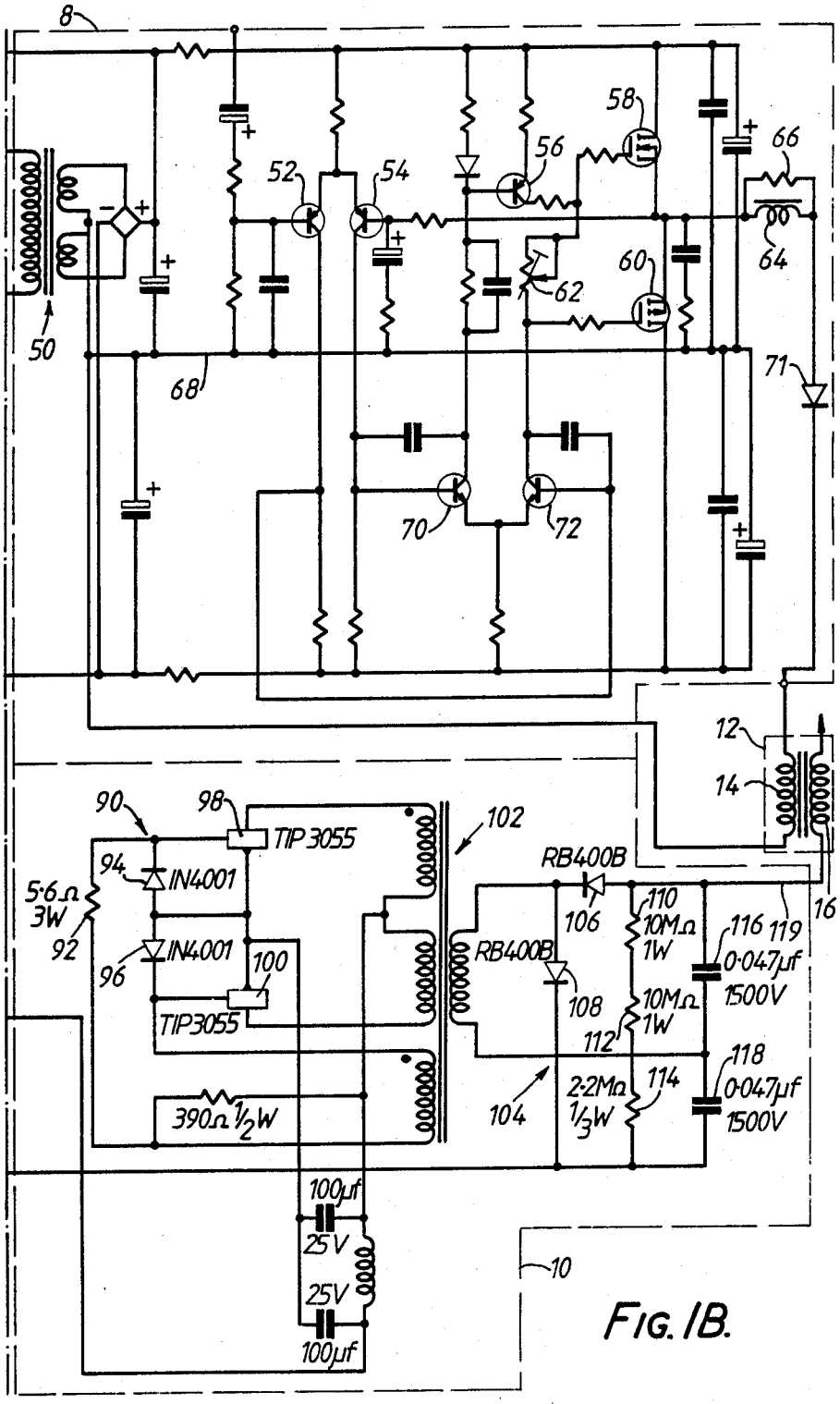

An embodiment of the invention will now be described solely by way of example and with reference to the accompanying drawings in which:

FIGS. 1A and 1B show a circuit for ignition apparatus for providing plasma ignition for an engine.

Referring to the drawings, there is shown a circuit drawing forming ignition apparatus 2 for providing plasma ignition for an engine. The ignition apparatus 2 comprises a switching circuit 4, wave form generator means 6 for generating an a.c. square wave form output, a power amplifier circuit 8 for amplifying the output from the square wave form generator means 6, and a d.c. to d.c. inverter 10. The ignition apparatus 2 further comprises transformer means 12 which is the ignition coil for the engine. The transformer means 12 has a primary winding 14 and a secondary winding 16. The primary winding 14 is connected to the power amplifier circuit 8 for receiving the output from the power amplifier circuit 8. The secondary winding 16 is connected to the d.c. to d.c. inverter 10.

The ignition apparatus 2 is such that the square wave form generator means 6 and the d.c. to d.c. inverter 10 are connected in parallel so that during operation of the ignition apparatus 2 high voltage a.c. from the wave form generator means carries and sustains d.c. which is from the d.c. to d.c. inverter and which is required for the plasma. The wave form generator means 6 and the d.c. to d.c. inverter 10 remain running during use of the ignition apparatus 2 until the switching circuit 4 is switched off, so that the a.c. is always present to carry and sustain the d.c. for the plasma.

The switching circuit 4 comprises a transistor 18, a pair of resistors 20,22 connected across the transistor 18, and a capacitor 24 connected across the pair of resistors 20,22. A further resistor 26 is provided as shown and is connected in series with the resistor 20. The switching circuit 4 activates the various components within the ignition apparatus 2 when circuit breaker contacts (not shown) open.

The wave form generator means 6 comprises a square wave form generator 28, and a pre-amplifier 30 for amplifying the output from the square wave form generator 28, and for providing an amplified signal for the power amplifier circuit 8. The wave form generator means 6 in effect constitutes a 1.5 kilocycle oscillator circuit.

The wave form generator means 6 includes a duty cycle device 32 for controlling the operating time of the square wave form generator 28.

The wave form generator means 6 also includes a low frequency adjust device 34 and a high frequency adjust device 36 which are connected as shown and which are for setting up the square wave form generator means 6 during production.

The wave form generator means 6 includes a diode 38 which is connected in circuit as shown so that it is able to remove surge pulses from the top of the circuit. The wave form generator means 6 further includes a sine purity device 40 which is connected as shown between resistors 42,44,46,48. The sine purity device 40 is for providing a cleaning up effect on the wave form generated by the square wave form generator 28 in order to ensure that a desired good square wave form is obtained. As shown, the sine purity device 40 enables tuning and adjustment to get the required square wave form.

As mentioned above, the output from the pre-amplifier 30 passes to the power amplifier circuit 8. The power amplifier circuit 8 is able to provide, for example, 200 watts energy into the primary winding 14 of the transformer means 12. The power amplifier circuit 8 comprises a transformer 50 which is connected as shown to transistors 52,54,56. The transistor 56 also connects as shown to a pair of push pull transistors 58,60 and a variable resistance 62. The transistors 52,54,56,58,60 form part of a pre-amplifier circuit part which outputs to a transformer 64. A resistance 66 is connected in parallel with the transformer 64. The pre-amplifier circuit part is above line 68. Below line 68 is a power amplifier circuit part which operates in a push pull mode and which includes transistors 70,72 and the illustrated capacitors and resistances.

The output from the transformer 64 connects to the primary winding 14 of the transformer means 12 via a diode 71. The diode 71 gives half wave rectification.

The d.c. to d.c. inverter 10 comprises an oscillator circuit 90. The oscillator circuit 90, as shown, includes a resistor 92, a pair of diodes 94,96 connected in back to back fashion and a pair of transistors 98,100 which are connected as shown to the diodes 94,96. The oscillator circuit 90 is effective to step up twelve volts to twelve kilo-volts d.c. The oscillator circuit 90 as will be appreciated, converts d.c. to a.c. which is then used to drive an output transformer 102. The high voltage a.c. is then rectified using a rectifier circuit 104. The rectifier circuit 104 gives a high voltage d.c. output for the secondary winding 16 of the transformer means 12. The rectifier circuit 104 employs the illustrated diodes 106,108, the resistors 110,112,114 and the capacitors 116, 118 to give half wave rectification.

The d.c. to d.c. inverter 10 gives a negative d.c. output on line 119. This negative d.c. output thus goes to the base of the secondary winding 16 of the transformer 12. The high voltage wave form provided by the power amplifier circuit 8 must be of the same electrical potential output as the d.c. to d.c. inverter 10, creating a high energy unquenchable plasma in the combustion chamber of the engine.

The ignition apparatus 2 operates such that it runs at the moment the trigger source goes open circuit, i.e. when the switching circuit 4 is switched on. The wave form generator means 6 and the d.c. to d.c. inverter 10 are switched on simultaneously and they remain running until the switching circuit 4 is switched off. The duration of the switching on may be a function of the trigger circuit or it may be a pre-programmed condition by an engine management system, thus producing the required energy and spark duration for optimum conditions at the appropriate point of the engine operating cycle. The high frequency a.c. square wave form which is output from the square wave form generator 28, the pre-amplifier 30 and the power amplifier circuit 8 carries the d.c. voltage from the d.c. to d.c. inverter 10 to form the plasma source for the engine. In effect, the ignition apparatus 2 is such that a high frequency a.c. component which is carrying a high voltage d.c. component, sustains a plasma at the spark plug or plugs and/or the ignitor unit or units of the engine for the entire duration of the combustion cycle. The plasma does not quench easily, even at high swirl conditions, and the ignition apparatus 2 can be run at a sufficiently low d.c. level not to get excessive vapourisation of plug electrodes, distributor rotors and contacts within distributor caps. In addition, the ignition apparatus 2 lends itself for being totally programmed (in relation to energy dumped into a combustion chamber of the engine) proportional to engine speeds, engine load variations and fuel mixture changes. These energy factors can be controlled by controlling the voltage input to the d.c. to d.c. inverter 10.

It is to be appreciated that the embodiment of the invention described above with reference to the accompanying drawings has been given by way of example only and that modifications may be effected. Thus, for example, the rectifier circuit 104 may be modified such that instead of giving the present very high frequency half wave rectification, it gives instead very high frequency full wave rectification. If desired, the d.c. to d.c. inverter 10 may be switched on prior to the wave form generator means 6 being switched on. The prior switching of the d.c. to d.c. inverter 10 needs only to be by a few milliseconds. The prior switching of the d.c. to d.c. inverter 10 may be beneficial in re-ionising the ignition circuit, for example the rotor gap and the plug electrode, before ignition occurs.

I claim:

1. Ignition apparatus for providing plasma ignition for an engine, which ignition apparatus comprises a switching circuit, wave form generator means for generating an a.c. wave form output, a power amplifier circuit for amplifying the ouput from the wave form generator means, a d.c. to d.c. inverter, and transformer means having primary and secondary windings, the primary winding being connected to the power amplifier circuit for receiving the output from the power amplifier circuit, and the secondary winding being connected to the d.c. to d.c. inverter, and the wave form generator means and the d.c. to d.c. inverter being connected in parallel so that during operation of the ignition apparatus high voltage a.c. from the wave form generator means carries and sustains d.c. which is from the d.c. to d.c. inverter and which is required for the plasma.

2. Ignition apparatus according to claim 1 in which the switching circuit comprises a transistor, a pair of resistances connected across the transistor, and a capacitance connected across the pair of resistances.

3. Ignition apparatus according to claim 1 in which the wave form generator means comprises a square wave form generator, and a pre-amplifier for amplifying the output from the square wave form generator and for providing an amplified signal for the power amplifier circuit.

4. Ignition apparatus according to claim 3 in which the wave form generator means includes a duty cycle device for controlling the operating time of the square wave form generator.

5. Ignition apparatus according to claim 1 in which the d.c. to d.c. inverter comprises oscillator means for converting low voltage d.c. to low voltage a.c., transformer means for receiving the low voltage a.c. output from the oscillator means and for generating high voltage a.c., and rectifier means for rectifying the high voltage a.c. into high voltage d.c.

6. Ignition apparatus according to claim 5 in which the rectifier means is a half wave rectifier means.

* * * * *